US006607195B2

(12) United States Patent
Vancura

(10) Patent No.: US 6,607,195 B2
(45) Date of Patent: Aug. 19, 2003

(54) BETTING BYSTANDER METHOD AND APPARATUS

(75) Inventor: Olaf Vancura, Las Vegas, NV (US)

(73) Assignee: Mikohn Gaming Corporation, Las Vegas, NV (US)

( * ) Notice: Subject to any disclaimer, the term of this patent is extended or adjusted under 35 U.S.C. 154(b) by 0 days.

(21) Appl. No.: 10/261,145

(22) Filed: Sep. 30, 2002

(65) Prior Publication Data

US 2003/0047871 A1 Mar. 13, 2003

Related U.S. Application Data

(63) Continuation of application No. 09/690,777, filed on Oct. 17, 2000.

(51) Int. Cl.[7] ..... A63F 1/00
(52) U.S. Cl. ..... 273/274; 273/292
(58) Field of Search ..... 273/274, 292, 273/309; 463/12, 13

(56) References Cited

U.S. PATENT DOCUMENTS 4,861,041 A 8/1989 Jones et al.
5,098,107 A 3/1992 Boylan et al.
5,390,934 A 2/1995 Grassa
5,494,296 A 2/1996 Grassa
5,615,888 A 4/1997 Lofink et al.
5,653,444 A * 8/1997 Dahl
5,673,917 A 10/1997 Vancura
5,707,285 A * 1/1998 Place et al.
5,806,846 A 9/1998 Lofink et al.
5,842,698 A * 12/1998 Brown
5,863,041 A * 1/1999 Boylan et al.
5,868,392 A * 2/1999 Kraft
5,911,418 A * 6/1999 Adams

* cited by examiner

*Primary Examiner*—William M. Pierce
(74) *Attorney, Agent, or Firm*—Dorr, Carson, Sloan & Birney, P.C.

(57) ABSTRACT

A method for playing a base and bonus live card games with side betting. A video board is used for bonus game play if a predetermined arrangement of cards is dealt in the base game. When a player gets the predetermined arrangement the player can play the bonus game. The other players who made side bets, under one embodiment, are also awarded when the bonus game player wins the bonus game and, under another embodiment, when the bonus game player loses the bonus game. In other embodiments, side bets are not needed for the other players to be awarded based upon the bonus game being won or lost.

6 Claims, 3 Drawing Sheets

BETTING BYSTANDER METHOD AND APPARATUS

RELATED APPLICATION

This application is a continuation of U.S. patent application Ser. No. 09/690,777 filed on Oct. 17, 2000.

FIELD OF THE INVENTION

The invention relates to casino games with the objective to inspire more players to make a side wager or continue to play a casino game. The inspiration comes from the possible occurrence of a random event during the play of the game so the event pays off not only the individual player and possibly the other bystander players.

BACKGROUND OF THE DISCLOSURE

There is a continuing need to add excitement to casino offerings. One manner in which this has been done is through the use of optional side wagers to an underlying game. In particular, side wagers to Blackjack have become plentiful in recent years.

A desired quality of any Blackjack side bet is that it be optional. In this way, players who do not want to make the side bet are not required to do so. Players not making the side wager instead play a normal Blackjack game. From a casino point of view, making the side bet optional is also desirable, for there is then very little risk in introducing it. If the side bet is unsuccessful (no one wants to wager on it), the Blackjack table reverts back to its classic play by default.

Optional Blackjack side wagers include Over/Under 13, Super 7s, Top of the Deck, Royal Match (Boylan et al., U.S. Pat. No. 5,098,107) and Bust-Out wagers. Too, a separate jackpot wager achieved through a predetermined arrangement of cards has been proposed (Jones et al., U.S. Pat. No. 4,861,041).

The Top of the Deck wager includes a side bet on if the player and/or dealer will receive a natural (a two-card total of 21). It has no "play" value, per se, in that the outcome of the wager is decided merely on the basis of the first two cards dealt to the player and/or dealer. Top of the Deck suffers with restrictive rules as to when players can make the bet (only immediately after a shuffle). Thus, players can make the wager typically only once every few hands.

The Over/Under 13 wager is a side bet on whether the player's first two cards will total over or total below 13. It is made at the start of a new hand. There is no decision for the player once the bet has been made.

The Royal Match wager is a side bet on whether the player's first two cards will be of the same suit. It is made at the start of a new hand but is also another completely passive bet.

The Super 7s wager has a bet on if the player will receive one or more Sevens in his/her hand. It too is made at the start of a new hand and it is almost completely passive as the player has a decision to make roughly once in every 170 hands. But in all other cases (the vast majority), there is nothing to do. Indeed, any jackpots paid on a predetermined arrangement of rare cards (cf. U.S. Pat. No. 4,861,041 mentioned above) succumb to this problem.

Vancura (U.S. Pat. No. 5,673,917) describes a side wager that allows players to wager on the number of hits that they and/or the dealer will ultimately take. The resolution of the main Blackjack wager can proceed as usual. Unlike the aforementioned Blackjack side wagers, players are actively in control of their fortunes and can play hands as they wish.

Boylan et al. (U.S. Pat. No. 5,863,041) describe a side wager to Pai Gow poker in which an "envy bet" is taught. The "envy bet" is a side wager of a minimum amount and allows the player to also be paid, should another player receive a hand of predetermined rank.

The game of Spanish 21 (Lofink, U.S. Pat. Nos. 5,615,888 and 5,806,846) modifies Blackjack and includes a bonus on the main wager. There is an opportunity of several players winning if someone gets special predetermined cards. In Spanish 21, the player receiving the predetermined cards wins in addition to all other players.

Rainbow Blackjack, (Grassa, U.S. Pat. Nos. 5,390,934 and U.S. Pat. No. 5,494,296) wherein the rules of play are the same but each player is assigned a color and players are allowed to wager on each other's colors, is another try that is reminiscent of back-lining, where others can wager with a particular player.

While the above casino games are each unique, none of them have the desirable feature of allowing a bystander player (one who wagers on the base game but not necessarily on any side bet) to receive an award based on the outcome of a side wager. Furthermore, none of these games afford one player an award based upon another player losing a wager.

There is therefore the need for side wagers that are exciting, easy-to-play, encourages play, and allows players to formulate their own strategy. There is the need to add excitement to wagering players not currently "in the game" to minimize boredom. There is the need for a casino game that allows a bystander player to receive an award based on the outcome of another player's side wager. There is the need for a casino game in which one player may win based upon another player losing.

BRIEF SUMMARY OF THE INVENTION

Described herein is a casino game that allows a bystander player to receive an award based on the outcome of another player's side wager. In a preferred embodiment, one player may win based upon another player losing.

A preferred method uses a side wager associated with the conventional game of casino Blackjack. The preferred game is played on the standard Blackjack table with an extra area for making each player to side wager adjacent to the area delineated for making the main wager. There is a video screen for play of the bonus game, in a preferred embodiment including the MONOPOLY® game. In principle, wagers may be made with money, gaming chips, credits, or their video or mechanical equivalent and preferably the bonus game is played in a bonus round by a player that has achieved entry thereto during play of a base game of cards. More particularly, the entry into the bonus game requires that the players make a side bet on the occurrence of a predetermined outcome of the base game and the outcome indeed happen.

The game has a method of paying off according to Blackjack rules modified to include a bonus round with incentives for all Blackjack players. The rest of the rules for the base game of Blackjack are normal remaining exactly as before. Indeed, the resolution of the main wager may proceed in exactly the same fashion as in ordinary play. In this way, the invention conforms to the subtle yet common variations in rules and/or conditions that exist between casinos. In the preferred embodiment, the introduction of side betting of bystanders does not cause the overall "optimal" Blackjack strategy to change whatsoever.

Unlike the existing Blackjack side bets where the player has little, if anything, to do, this invention affords the player considerable interest in the outcome of the bonus game. Playing Blackjack with the classical "basic strategy" (a set of rules meant to optimize the player's expectation taking into account only information from the present player and dealer hands) does not guarantee winning on the side bet. The outcome of the side bet is exciting but subject to chance due to random selection.

In another embodiment, players may make the side wager on the dealer's hand, in addition to their own.

DETAILED DESCRIPTION OF THE INVENTION

Figure 1:
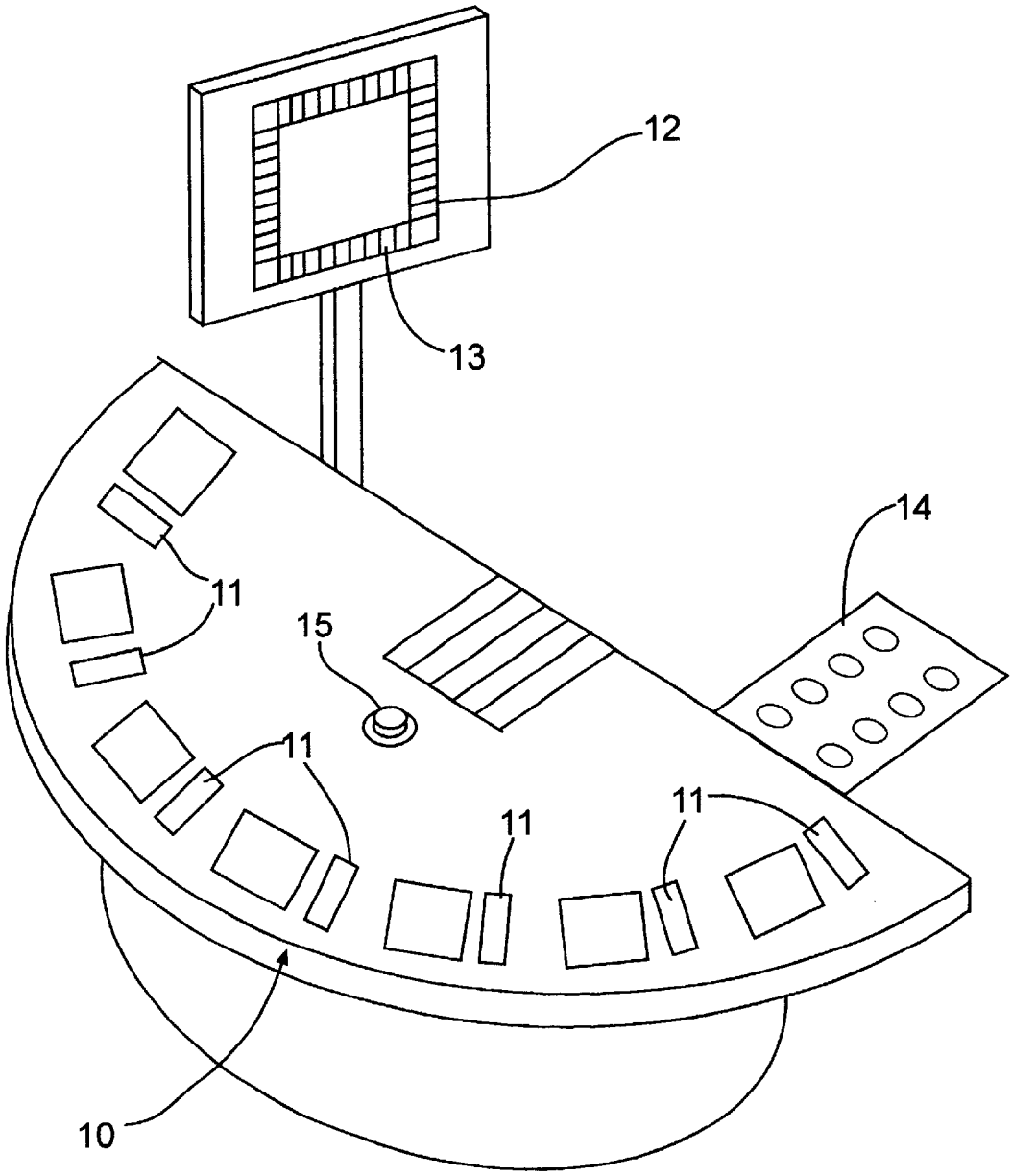
FIG. 1 is a top view illustration shown in perspective of a layout for the preferred embodiment of the equipment.
Figure 2:
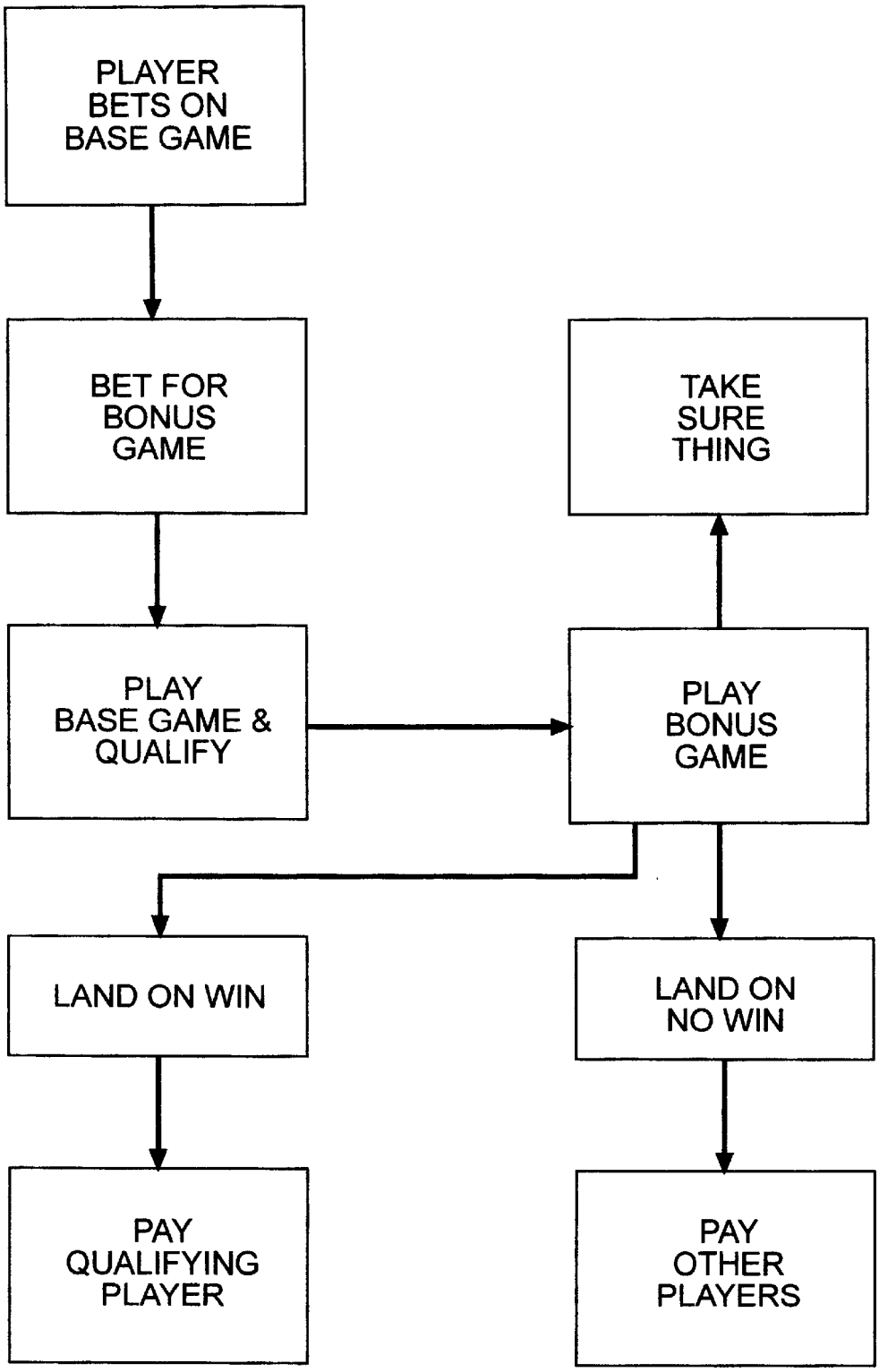
FIG. 2 is a flow chart showing some steps in the method of play of the preferred game.

A detailed specification of the preferred game 10 of MONOPOLY® Blackjack includes a place 11 for side wagers for each of the players. When used herein, the trademarks, MONOPOLY® and Mr. MONOPOLY® are those belonging to Hasbro, Inc. The MONOPOLY® BLACKJACK card game includes a side wager in Blackjack to participate in the bonus game. Upon a player achieving a qualifying hand, the icon, Mr. MONOPOLY®, offers the qualifying player the choice of a fixed prize or the chance to play "the MONOPOLY® game" by "going to the board." In this manner, the qualifying player with the qualifying hand has an active choice in how the bonus game proceeds. If the player with the qualifying hand chooses to play the MONOPOLY® game, play begins on a MONOPOLY® board 12 (preferably a video screen) with movement thereabout by a token 14. The award is based on the square 13 randomly selected. For traditional squares 13, the qualifying player receives odds on his/her wager. But if the qualifying player lands in the square 13 designated, "Jail", he/she wins nothing but instead a "Good Samaritan" or "bystanders' bonus" is granted to all other Blackjack side bettors. The terms, "Good Samaritan" or "bystanders" are used throughout this disclosure to cover the other players that are not the qualifying player that is playing directly for the bonus.

In a preferred embodiment this betting bystanders' bonus is awarded to all Blackjack players, whether or not they have made the side wager for the bonus game. Alternatively, the bystanders' bonus could be paid only when the qualifying player gets a randomly selected bonus move that does not pay him/her. In another alternate embodiment, the "bystanders' bonus" is awarded only to those players who have made a side wager.

Game Specifics

Rules of Play for Blackjack Style Game

To begin play, each player makes a wager on one of two optional side wagers on the qualifying hand: either"Red Blackjack" or"Black Blackjack." In FIG. 1 place 11 is shown as a rectangle but any indication of whereat to bet is within this disclosure including two areas for making each side bet wagers or two coin acceptors. Each wager pays 10 to 1 for a Blackjack that is not the correct color. For example, a player betting on "Red Blackjack" receives 10 to 1 for a mixed color Blackjack consisting of, for example, a red ace and black king, etc. A player betting on "Red Blackjack" also receives 10 to 1 for a Black Blackjack consisting of, for example, a black ace and a black ten, etc.

When the side wagering player is dealt a Blackjack or a two card total of 21 that is, a qualifying hand, e.g. the monochromatically correct color-combination, he/she is said to have qualified to play the bonus game. There is about a 1 in 84 chance of qualifying for each color side wager, hence roughly a 1 in 42 chance for a bettor that wagers on both "Red Blackjack" and "Black Blackjack".

The MONOPOLY® BLACKJACK bonus game begins and the player is offered the choice of one of the following: (a) a sure award of fixed odds, or (b) the option to play "the MONOPOLY® game."

Taking fixed odds ends the bonus game. The player is paid according to the fixed odds. This may be referred to as a "sure thing" since there is no risk involved in making this decision.

Figure 3:
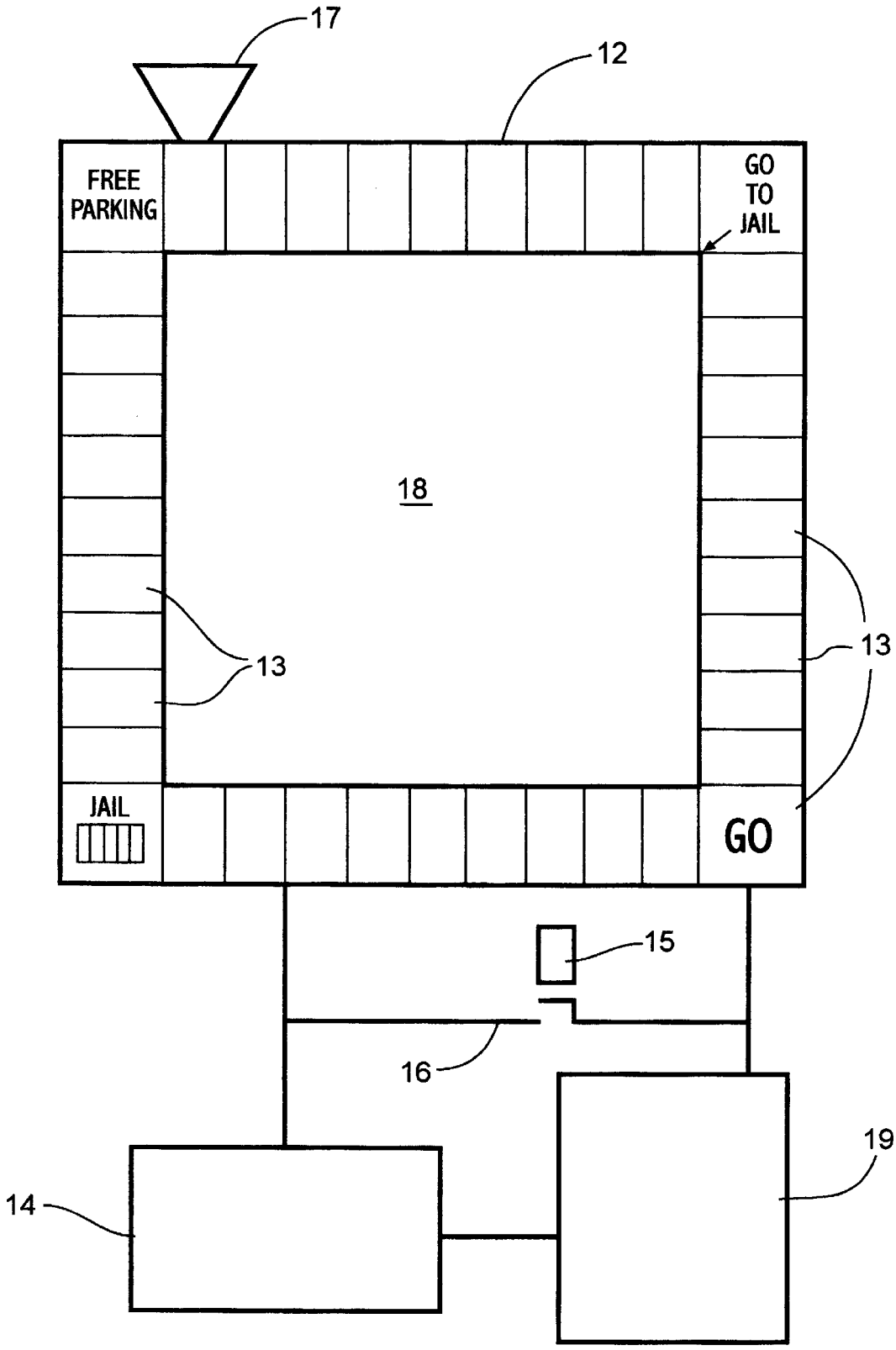
FIG. 3 is a schematic diagram of the electronic equipment of the MONOPOLY® Blackjack version of the current invention.

Instead, if the player is so inclined, the player may elect to play the MONOPOLY® game, which is then invoked on board 12 shown in FIGS. 1 and 3. During the game, a single square 13 is selected randomly (by a method to be explained later) to determine the outcome of the bonus game. Standard squares 13 pay the player associated odds on his/her wager. Special squares 13, for example ("Go To Jail", "Jail") pay the player nothing, but all other (non qualifying hand) players are paid a "Good Samaritan" or "bystanders' bonus" of fixed odds. Thus, an incentive to play at this table (as opposed to a standard Blackjack table) is afforded to all the other players (whether making the side wager or not in the preferred embodiment) side-betting bystanders who did not qualify and thus are not actively playing in the bonus round.

Algorithmic Flow (Only Side Wager is Portrayed)

1) Player wagers on MONOPOLY® BLACKJACK base game 10 and has a side bet at place 11.
2) If player does not receive a Blackjack, side wager is taken, return to step #1.
3) If player receives a Blackjack but not the correct color type, he/she is paid 10 to 1 for each such side wager. If player does not have a Blackjack of the correct type, return to step #1.
4) If player receives a Blackjack of the correct type, dealer initiates bonus sequence via control panel. On the video screen showing board 12 a 3-dimensional Mr. MONOPOLY® icon welcomes the winning player to "MONOPOLY® Blackjack" as the bonus round. That icon explains that the winning player has a choice by saying, "Welcome! Choose either sure 20 to 1 odds or play the MONOPOLY® game."
5) If player selects fixed pay, he/she is paid accordingly. The dealer enters the player's choice via a control panel 14. Return to step #1.
6) If player selects to play the MONOPOLY® game, the dealer enters that choice via the control panel 14. The screen then changes to show a MONOPOLY® game board having a path of squares 13 for play. An animation of a locomotive begins circling the path of squares 13 at high speed starting from the lower-right"Go" square 13. A plunger 15 shown in FIG. 1 connects to a switch 16 in FIG. 3 is automatically armed by the dealer's entry of the player's choice. Upon the locomotive crossing each square 13, that square 13 is highlighted.
7) Upon the bonus round player pressing the plunger, an accompanying sound effect, e.g. train brakes applied, is presented to signal the plunger 15 application. The train concurrently begins to decelerate, and the "odds" values associated with each square 13 (corresponding to current highlighted square 13 beneath the train location) immediately is shown in the center of the game board 18 and designated as, "Title Deeds". After at least one-half but not more than one and one-half revolutions, the locomotive randomly comes to rest on, the MONOPOLY® game; a specific property in a particular square 13 and that position of rest is purely a chance event. This property of that square 13 is announced and that determines the outcome of the bonus round of the MONOPOLY® game.

8) Should the locomotive have come to rest on a standard (non-Go To Jail, non-Jail) property, the Mr. MONOPOLY® icon announces the property. The player is paid appropriate odds associated with the square 13 for the property landed upon. Return to step #1.

9) If the locomotive came to rest on the squares 13 labeled "Chance" or "Community Chest", the Mr. MONOPOLY® icon announces the square 13. Additional animation then depicts appropriate cards shuffling and top-card is revealed (e.g., "2$^{nd}$ Prize in Beauty Contest") and the Mr. MONOPOLY® icon then announces the event. Player is paid appropriate odds according to that randomly selected event. Return to step #1.

10) Should the locomotive have come to rest on the square 13 marked, "Go To Jail" or "Jail", animation is depicted of a jail cell closing on the Mr. MONOPOLY® icon, while stating, "Good Samaritan bonus! Pay all other MONOPOLY® Blackjack players 7 to 1 odds!" Return to step #1.

Associated odds for squares 13, shown schematically in FIG. 3, have in a preferred embodiment the values attainable during play of board 12 for pay off to the player:

| | |
|---|---|
| Go | 75 to 1 |
| Purple 1 | 10 to 1 |
| CC | 42 to 1 |
| Purple 2 | 11 to 1 |
| Income Tax | 15 to 1 |
| RR 1 | 25 to 1 |
| Azure 1 | 14 to 1 |
| Chance | 42 to 1 |
| Azure 2 | 14 to 1 |
| Azure 3 | 15 to 1 |
| In Jail | Zero Note, the Good Samaritans' or betting bystanders' Bonus of 7 to 1 is paid on all other bettors' wagers. |
| Magenta 1 | 18 to 1 |
| Magenta 2 | 18 to 1 |
| Electric Co. | 12 to 1 |
| Magenta 3 | 20 to 1 |
| RR 2 | 25 to 1 |
| Orange 1 | 25 to 1 |
| Orange 2 | 25 to 1 |
| CC | 42 to 1 |
| Orange 3 | 30 to 1 |
| Free Parking | 50 to 1 |
| Red 1 | 35 to 1 |
| Chance | 42 to 1 |
| Red 2 | 35 to 1 |
| Red 3 | 40 to 1 |
| RR 3 | 25 to 1 |
| Yellow 1 | 45 to 1 |
| Yellow 2 | 45 to 1 |
| Water Works | 12 to 1 |
| Yellow 3 | 50 to 1 |
| Go to Jail | Zero Note, the Good Samaritans' or betting bystanders' Bonus of 7 to 1 is paid for all other side bettors' wagers |
| Green 1 | 75 to 1 |

-continued

| | |
|---|---|
| Green 2 | 75 to 1 |
| CC | 42 to 1 |
| Green 3 | 100 to 1 |
| RR 4 | 25 to 1 |
| Chance | 42 to 1 |
| Blue 1 | 150 to 1 |
| Luxury Tax | 15 to 1 |
| Blue 2 | 200 to 1 |

The list of chance events determined randomly appear in the middle 18 of the board 12 by simulated draw of a card from a deck:

| | |
|---|---|
| Tax Refund Arrives | 20 to 1 |
| Favorite Roulette # Pays Off | 35 to 1 |
| 2$^{nd}$ Prize Beauty Contest | 40 to 1 |
| 1$^{st}$ Place Blackjack Tourney | 50 to 1 |
| Stock Market Boom | 65 to 1 |

List of community chest events and is shown in the middle 18 of the board 12 by simulation:

| | |
|---|---|
| Slot Machine Jackpot | 20 to 1 |
| Visit Las Vegas | 25 to 1 |
| X-Mas Fund Matures | 40 to 1 |
| Bank Error in Your Favor | 50 to 1 |
| Lottery Winner | 75 to 1 |

With the rules and conditions as given previously, the house advantage is a function of how many other side wagers are made concurrently. This is due to the "Good Samaritan" or "bystanders' bonus" feature, which all players receive when someone lands in jail. For a table 10 in which all positions wager on the base game, each individual side wager has a house advantage of 7.38%. For a table 10 with only a player wagering on the base game and side wager, the house advantage is 12.78%. All other cases fall in between these bounds. It is an advantage of this invention that as the number of players increases, the house advantage per player decreases. The invention thus has a stabilizing effect on overall revenue.

Hardware Description

In FIGS. 1 and 3 a 17" or 18" LCD flat-screen full-color panel is shown for board 12 mounted on the card table 10 and is visible to all players and dealer. Remote radio frequency switch 16 is accessible to the player in the shape of the small plunger 15 with a thematic "top hat" shell, see FIG. 1. Dealer control pad 14 is used to control the play of the bonus game after arming the remote radio frequency switch 16.

Associated computer hardware 19 in FIG. 3 connected to the remote radio frequency switch 16 and the control pad 14 for game functionality is shown schematically and can be positioned remotely.

While the preferred embodiment includes a MONOPOLY® bonus game 10, those skilled artisans will appreciate that the side betting bystander's bonus can be included in any form of random selection bonus game. Blackjack as a base game is shown and described as the preferred embodiment. That is not to say that other table card games such as Caribbean Stud® poker, Let It Ride card game, Pai Gow poker, etc. could not be adapted to this invention by one skilled in the art. Also non-side-betting bystanders are afforded a chance to win in the preferred embodiment but that is not essential. An alternate game might require a side bet to participate in the bonus. The bonuses are fixed amounts in the example but one or more could be linked to a progressive jackpot.

Note also that while the foregoing has been presented in terms of an optional side wager, the invention can also be utilized as a primary wager. In this case, all other players wagering simultaneously may be considered the "side wagering bystander players." In particular, the novel feature of paying others when the qualifying hand player loses can still be used in the embodiment wherein the invention is a primary wager. In the claims that follow the term, "payment" is credits or money as this is a casino game and may results from a win of fixed odds or a jackpot including a progressive.

What is claimed is:

1. A method of playing a casino live card base game having a bonus game wherein a dealer deals cards to a plurality of players in the casino live card base game at a table, the method comprising:

providing each of the plurality of players with a main wagering area and at least one side wagering area;

each of the plurality of players placing a main wager on their corresponding main wagering area to participate in the casino live card base game;

permitting each of the plurality of players to place a side wager optionally on their corresponding at least one side wagering area at the time of placing the main wager to participate in the bonus game;

if a predetermined arrangement of cards are dealt by the dealer to one of the plurality of players during play of the casino live card bonus game, then allowing the one player with the predetermined arrangement of cards to play the bonus game;

paying any of the plurality of players, not including the one player playing the bonus game, that placed an optional side wager according to the outcome of the bonus game.

2. The method of playing according to claim 1 wherein paying further comprises:

paying an award when the one player playing the bonus game loses the bonus game.

3. The method of playing according to claim 1 wherein paying further comprises:

paying an award when the one player playing the bonus game wins the bonus game.

4. A method of playing a casino live card base game having a bonus game wherein a dealer deals cards to a plurality of players in the casino live card base game at a table, the method comprising:

providing each of the plurality of players with a main wagering area;

each of the plurality of players placing a main wager on their corresponding main wagering area to participate in the casino live card base game;

if a predetermined arrangement of cards are dealt by the dealer to one of the plurality of players during play of the casino live card bonus game, then allowing the one player with the predetermined arrangement of cards to play the bonus game;

paying the remaining plurality of players, not including the one player playing the bonus game, according to the results of the bonus game.

5. The method of playing according to claim 4 wherein paying further comprises:

paying when the one player playing the bonus game loses the bonus game.

6. The method of playing according to claim 4 wherein paying further comprises:

paying when the one player playing the bonus game wins the bonus game.

* * * * *